US008387525B2

(12) United States Patent
Kaptein

(10) Patent No.: US 8,387,525 B2
(45) Date of Patent: Mar. 5, 2013

(54) SELF-SEALING AUGER COMPACTOR BIN SYSTEM

(75) Inventor: Herman G. Kaptein, Duvall, WA (US)

(73) Assignee: Sani-Tech Systems, Inc., Duvall, WA (US)

( * ) Notice: Subject to any disclaimer, the term of this patent is extended or adjusted under 35 U.S.C. 154(b) by 334 days.

(21) Appl. No.: 12/880,440

(22) Filed: Sep. 13, 2010

(65) Prior Publication Data

US 2012/0060705 A1 Mar. 15, 2012

(51) Int. Cl.
*B30B 3/00* (2006.01)
*B30B 15/04* (2006.01)

(52) U.S. Cl. ..... 100/145

(58) Field of Classification Search ..... 100/117, 100/145, 146
See application file for complete search history.

(56) References Cited

U.S. PATENT DOCUMENTS

| | | | | | |
|---|---|---|---|---|---|
| 4,587,858 | A | * | 5/1986 | Bartholomay | 73/863.53 |
| 4,936,515 | A | * | 6/1990 | Poag et al. | 241/36 |
| 5,427,947 | A | * | 6/1995 | Dalos | 435/290.3 |
| 5,575,201 | A | * | 11/1996 | Fenner et al. | 100/39 |
| 5,592,869 | A | * | 1/1997 | Zittel | 99/348 |
| 6,112,679 | A | * | 9/2000 | Borstmayer et al. | 111/173 |

* cited by examiner

*Primary Examiner* — Jimmy T Nguyen
(74) *Attorney, Agent, or Firm* — Dean A. Craine

(57) ABSTRACT

A bin system that reduces the amount of trash that escapes through the auger hole formed on the bin. The system includes a bin with an auger hole formed on one end in which an auger nozzle is inserted. Mounted over the auger hole is a sealing disk assembly that includes a coaxially aligned ring spacer, an inner mounting ring affixed to the end of the bin, a flat circular elastic disk with an inner bore or circular valve, an outer ring and a plurality of threaded connectors. During operation, the auger nozzle is axially aligned over the bin's auger hole and the inner bore. When the bin is then forced over the auger nozzle, the elastic disk bends inward and stretches to create a tight seal around the auger nozzle. When the bin is moved, the auger nozzle is pulled through the disk which rebounds to its flat configuration.

4 Claims, 4 Drawing Sheets

SELF-SEALING AUGER COMPACTOR BIN SYSTEM

COPYRIGHT NOTICE

Notice is hereby given that the following patent document contains original material which is subject to copyright protection. The copyright owner has no objection to the facsimile or digital download reproduction of all or part of the patent document, but otherwise reserves all copyrights whatsoever.

BACKGROUND OF THE INVENTION

1. Field of the Invention

This invention relates to bins used to compact waste and trash, and more particularly to bins in which an auger is inserted into one end to compact trash and waste placed into the bin.

2. Description of the Related Art

Large businesses place waste and trash in large metal compaction bins which are periodically compacted on site. When the bin is full, a trash compaction company picks up the bin with a truck and replaces it with an empty bin.

Some bins include a welded or integrally attached hydraulic plunger located inside the bin that moves from one end to the other to compact waste and trash placed in the bin. Because the plunger is physically attached inside the bin, the size and hauling capacity of a truck used to transport the bin must be relatively large. The cost of transporting empty and full bins between locations is a large operating expense which waste and trash compacting companies are constantly looking for ways to reduce.

An alternative compact or bin system uses bins designed to be used with an auger compactor unit set up at a fixed location at the business site. The auger compactor unit includes an auger that rotates inside a cylindrical-shaped nozzle that extends through an auger hole formed on a swing door attached to one end of the bin. The auger inside the auger nozzle is periodically activated to compact waste and trash deposited in the bin. When the bin is full, the bin is then moved laterally to remove the auger nozzle from the auger hole. An empty bin is then moved in place. The full bin is transported to a disposal site where the swing door on the bin is opened to dump the waste and trash from the bin.

One drawback with auger compactor bins is small amounts of waste and trash may escape from the auger hole when the nozzle and auger are removed and when the full bin is being transported.

What is needed is an auger compactor bin with an auger hole formed on the swing door with a self-sealing disk that allows an auger nozzle and the auger to be selectively inserted into the auger hole and then automatically reseals the auger hole when the auger nozzle is removed from the bin thereby preventing waste and trash from escaping from the auger hole.

SUMMARY OF THE INVENTION

The invention is an auger compactor bin system that addresses and solves the problem of trash and waste escaping from the auger hole formed on the swing door of the bin when the bin is being removed from the auger nozzle and when the bin is being transported.

The system includes a bin with a swing door mounted on one end with a centrally located auger hole formed thereon. When the swing door is closed on the bin, the auger hole is longitudinally aligned on the bin and is sufficient in shape and size to receive an auger nozzle used with an auger compactor unit. Located inside the auger nozzle is an auger that is activated to compact waste and trash in the bin.

Mounted over the auger hole is a sealing disk assembly that includes a coaxially aligned ring spacer, an inner mounting ring affixed to the swing door of the bin, a flat circular elastic disk with an inner bore mounted over the inner mounting ring, and an outer mounting ring positioned over the elastic disk. During operation, the ring spacer creates a short tunnel or cylindrical sleeve around the auger hole and extends into the bin. The inner mounting ring is coaxially aligned with the auger hole and securely attached to the outside surface of the swing door and acts as a mounting surface for the elastic disk and the outer mounting ring. Formed on the inner mounting ring is a plurality of threaded holes which connect to a plurality of threaded connectors to hold the elastic disk and the outer mounting ring in a stacked position over the inner mounting ring.

The elastic disk assumes a flat configuration over the auger hole and is made of material sufficiently elastic so that its center portion bends inward when the auger nozzle is forced into the bin. In one embodiment, the elastic disk includes a small circular inner bore slightly smaller than that the auger nozzle that is enlarged by stretching when the auger nozzle forced into the elastic disk. In another embodiment, the inner bore is partially covered by a plurality of radially aligned slits that formed pie-shaped leaves that cover the inner bore.

When the auger nozzle is forced into the inner bore, the leaves bend inward and the small bore stretches around the auger nozzle. When the auger nozzle is forced through the small bore, the elastic disk assumes a conical configuration that extends over substantially covers the outside surface the auger nozzle. The elastic disk forms a continuous tight seal around the auger nozzle thereby preventing waste and trash from escaping from the space between the nozzle and auger hole during compaction. When the bin is removed from the auger nozzle, the elastic disk automatically rebounds to its original flat configuration and the small bore and leaves return to their original shape and orientation thereby keeping waste and trash from escaping.

DESCRIPTION OF THE PREFERRED EMBODIMENTS

Figure 1:
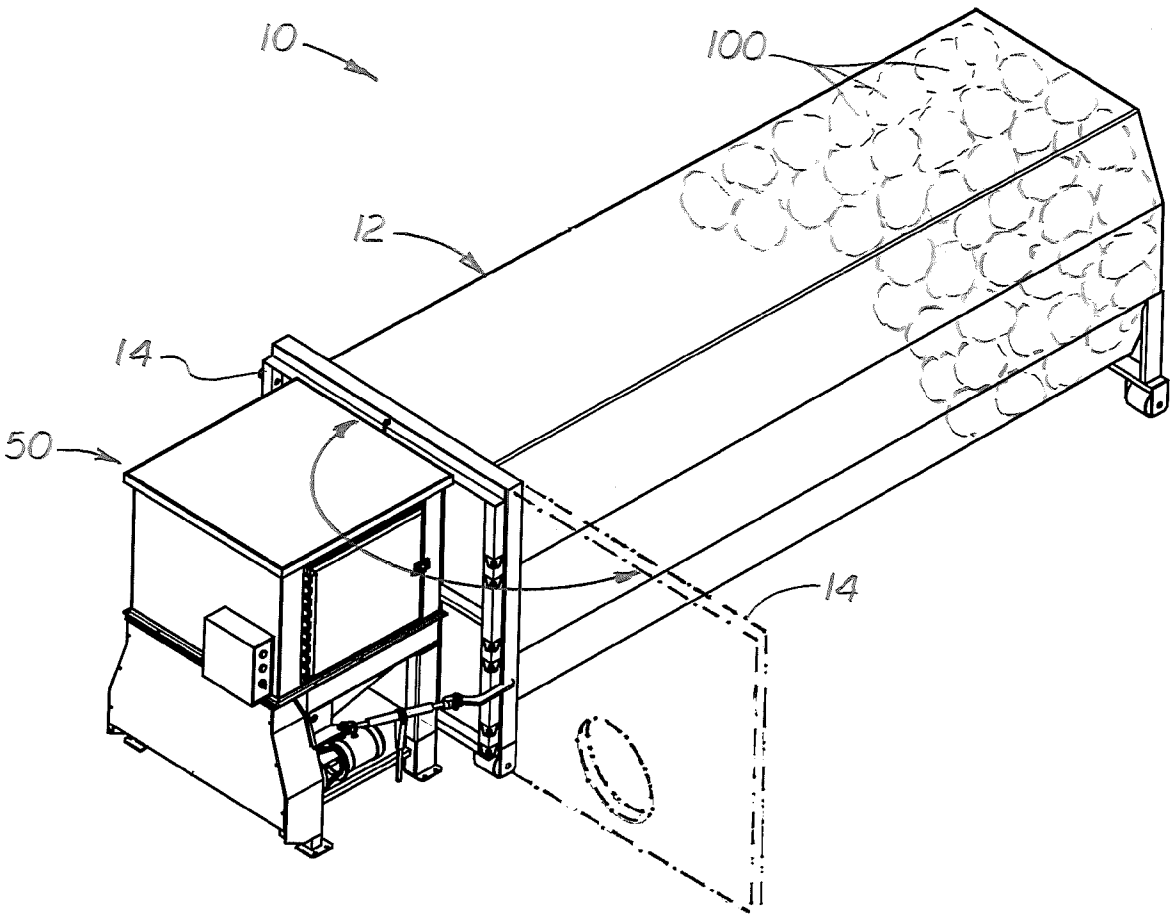
FIG. 1 is a perspective view of a trash and waste material bin with an auger assembly attached to one end.

Referring to the accompanying FIGS. 1-8, there is shown a system 10 that addresses and solves the problem of waste and trash 100 escaping from an auger hole 20 formed on the end of the bin 12 when the bin 12 is removed from the auger compactor unit 50.

Figure 3:
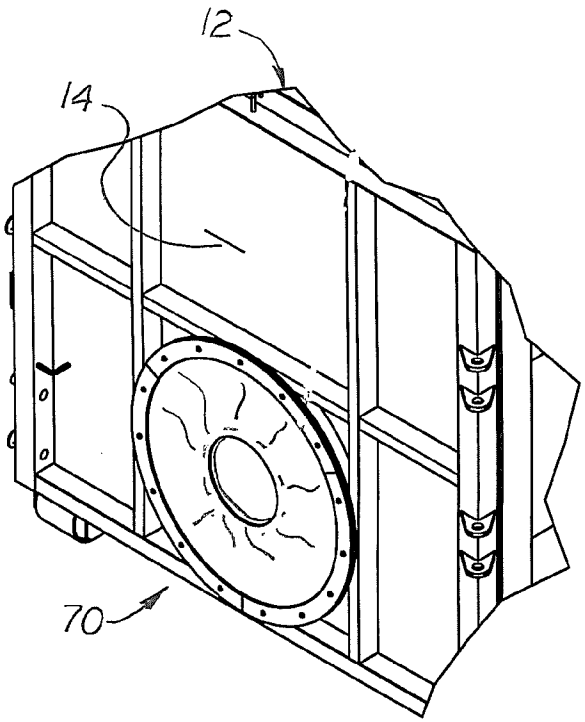
FIG. 3 is a perspective view of the end of the bin showing a sealing disk assembly mounted over the auger hole formed on one end of the bin.
Figure 2:
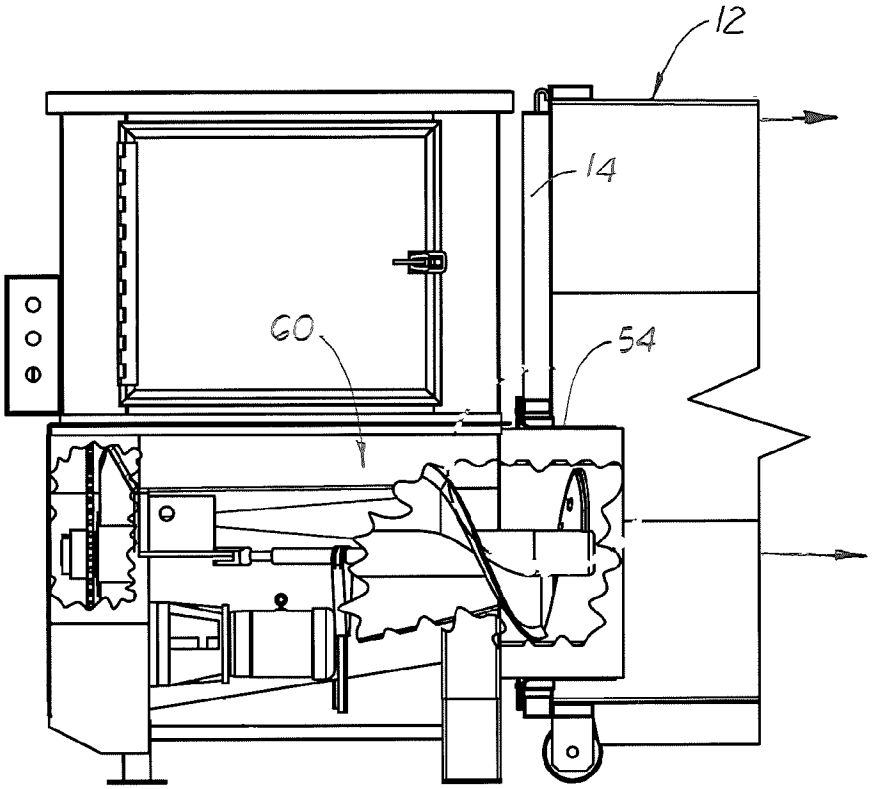
FIG. 2 is a partial side elevational view of the auger compactor assembly attached to the end of a bin to be filled with waste and trash.
Figure 5:
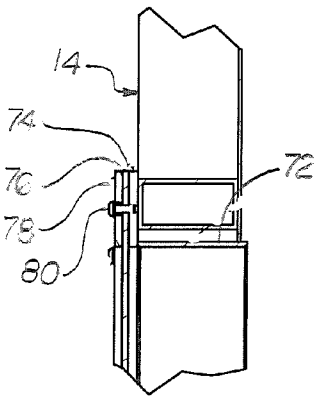
FIG. 5 is a sectional side elevational view of the top portion of the sealing disk assembly mounted on the closed position on a swing door attached to the bin.
Figure 6:
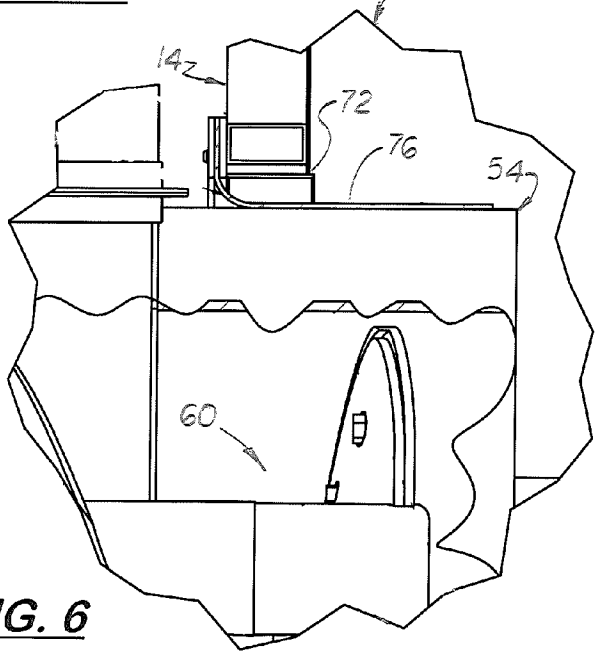
FIG. 6 is a sectional side elevational view of the top portion of the elastic disk assembly shown in FIG. 5 with the nozzle and spiral blade assembly inserted into the hole and forcing the elastic disk inward through the auger hole.
Figure 4:
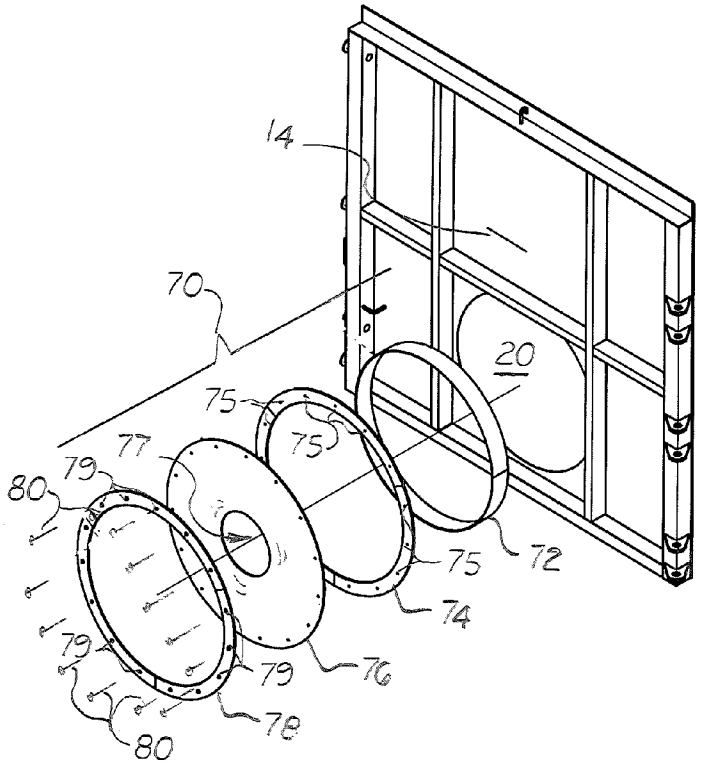
FIG. 4 is an exploded, perspective view of the sealing disk assembly shown in FIG. 3.

The system 10 includes a bin 12 with an auger compactor unit 50 used to compact waste and trash 100. The bin 12 includes a large swing door 14 that covers one end of the bin 12. In one embodiment, a relatively large auger hole 20 is formed on the swing door 14. The auger compactor unit 50 includes a main body 52 with a laterally extending cylindrical auger nozzle 54 attached thereto. Located inside the main body 52 is a motor 53 that rotates an auger 60 located inside the auger nozzle 54. The auger hole 20 formed on the swing door 14 is slightly larger in diameter than the auger nozzle 54 so that when the swing door 14 is closed on the bin 12, the swing door 14 may move freely over the auger nozzle 54. Coaxially aligned and mounted over the auger hole 20 is a sealing disk assembly 70 that creates a seal between the auger nozzle 54 and the auger hole 20 when the auger nozzle 54 is inserted into the auger hole 20 and creates a self-sealing, flat cover over the auger hole 20 when the bin 12 is being transported. As shown in FIG. 4, the sealing disk assembly 70 includes an optional coaxially aligned ring spacer 72, an inner mounting ring 74 affixed to the outside surface of the swing door 14, a flat circular elastic disk 76 with an inner bore 77, an outer mounting ring 78, and a plurality of threaded connectors 80. As stated above, the ring spacer 72 creates a short cylindrical surface formed around the auger hole 20. The inner mounting ring 74 is welded to the outside surface of swing door 14 and acts as a fixed mounting surface for the outer mounting ring 78. Formed on the inner mounting ring 74 is a plurality of threaded holes 75. The elastic disk 76 is circular and extends across the inner mounting ring 74. When at rest, the elastic disk 76 assumes a flat configuration and held in position between the inner mounting ring 74 and the outer mounting ring 78 as shown in FIG. 3. Formed on the outer mounting ring 78 is a plurality holes 79 that are aligned and registered with the threaded holes 75 formed on the inner mounting ring 74. Suitable threaded connectors 80 are used to connect to the threaded holes 75 formed on the inner mounting ring 74 with the holes 79 formed on the outer mounting ring 78 to hold the outer mounted ring 78 and the elastic disk 76 over the inner mounting ring 74.

Figure 7:
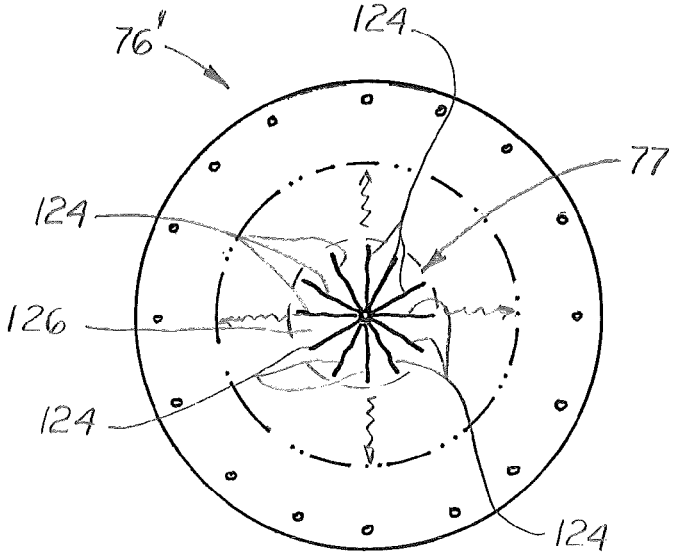
FIG. 7 is a front elevational view of the elastic disk with a small bore that includes radially aligned leaves that closed the small bore when the augur nozzle is not inserted into the small bore.
Figure 8:
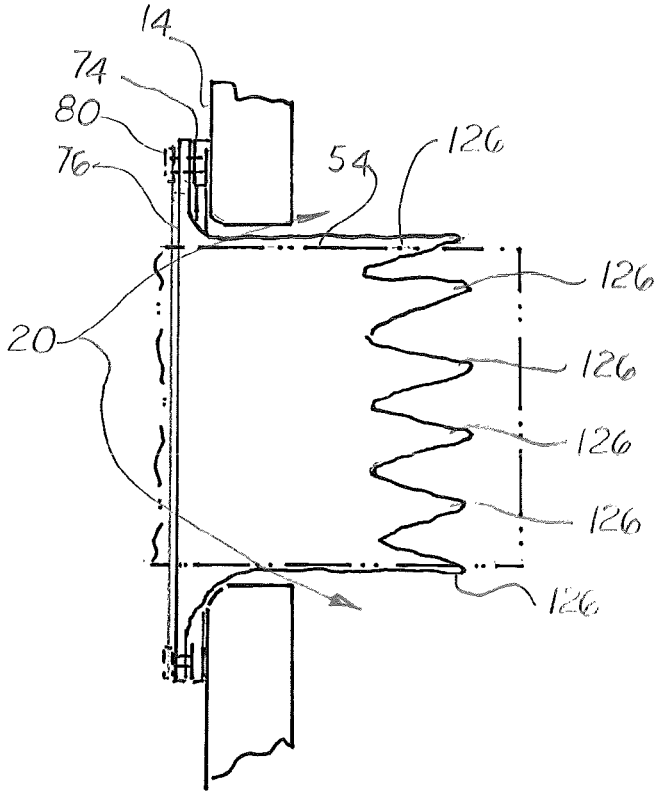
FIG. 8 is a side elevational view of the elastic disk shown in FIG. 7 deformed by an auger nozzle.

In FIGS. 7 and 8, a second embodiment of the elastic disk 76' wherein the inner bore 77' is covered by a plurality of radially aligned leaves 126. When an auger nozzle 54 is initially forced against the elastic disk 76', the leaves 126 bend rearward to form the inner bore 77'. When the auger nozzle 54 is forced further against the elastic disk 76', the inner bore77' stretches and conforms to the outer shape of the auger nozzle 54. When the auger nozzle 54 is removed, the elastic disk 76' regains its original flat configuration and the leaves 126 extend inward, substantially covering the inner bore 77'. The length of the slots 124 are approximately equal to the radius of the inner bore 77'.

In the embodiment shown in the Figs., the bin 12 measures ten to 20 feet in length, six to ten in width, and six to ten feet in height. The auger hole 20 measures twenty-four to forty-eight inches in diameter. In the preferred embodiment, the augur hole 20 has a diameter three to four inches larger than the diameter of the auger nozzle 54. During use, the bin 12 is positioned adjacent to the auger compactor assembly 50 so that the outside surface of the swing door 14 is adjacent to the main body 52 and the auger nozzle 54 extends into the auger hole 20. The auger nozzle 54 measures fourteen to eighteen inches in length.

The inner mounting ring 74, the elastic disk 76, 76' and the outer mounting ring 78 have identical diameters approximately four to six inchers larger than the auger hole 20. The elastic disk 76, 76' may be made of gum rubber, urethane, neoprene, buma, silicone, flora elastomer, viton, epdm, butyl, and SBR approximately one-fourth of an inch thick. The inner bore 77, 77' is coaxially aligned in the elastic disk 76, 76' and has a diameter approximately 33% (plus or minus 8%) of the outer diameter of the elastic disk 76, 76', respectively. For example, with an auger hole 20 that measures thirty-six inches in diameter, the diameter of the elastic disk 76, 76', respectively is approximately forty-four inches and the inner bore 77, 77' is approximately fourteen inches.

During operation, the auger nozzle 54 is forced through the inner bore 77, 77' on the elastic disk 76, 76', respectively, which stretches and bends inward in the space created between the inner mounting ring 72 and the auger nozzle 54. When the auger nozzle 54 is removed from the auger hole 20, the elastic disk 76, 76' return to their original flat configuration and act as a partial cover to keep trash and waste 100 from escaping. To remove the waste or trash 100 from the bin 12, the swing door 14 is swung to an open position and the bin's closed end is lifted so that waste and trash 100 falls from the bin 12.

In compliance with the statute, the invention described herein has been described in language more or less specific as to structural features. It should be understood however, that the invention is not limited to the specific features shown, since the means and construction shown is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. An improved bin and auger compactor system, comprising;

a. bin with a door that selectively opens and closes;

b. a auger hole formed on said door;

c. a ring spacer coaxially aligned inside said auger hole;

d. a flat inner mounting ring attached to said door and coaxially aligned around said ring spacer and said auger hole; and, e. a circular, flat elastic disk coaxially aligned over said inner mounting ring and cover said auger hole, said elastic disk includes a coaxially aligned inner bore, said elastic disk being made of sufficiently elastic material and said inner bore have a diameter so that when an auger nozzle is coaxially aligned with said auger hole and forced inward, said elastic disk bends and said inner bore stretches so that the auger nozzle partially extends thorough the inner bore, and then rebounds to its original shape and size when the auger nozzle is removed from said auger hole.

2. The bin and auger compactor system, as recited in claim 1, wherein said elastic disk is approximately ¼ inch thick and 24 to 48 inches in diameter.

3. The bin and auger compactor system, as recited in claim 1, wherein said elastic disk is made of one of the following materials from the following group of materials:

gum rubber, urethane, neoprene, buma, silicone, flora elastomer, viton, epdm, butyl, or SBR.

4. The bin and auger compactor system, as recited in claim 1, wherein said inner bore is formed by a plurality of radially aligned leaves separated by slits that bend inward when said auger nozzle is coaxially aligned and forced through said inner bore.

* * * * *